US007681501B1

(12) United States Patent
Wishert

(10) Patent No.: US 7,681,501 B1
(45) Date of Patent: Mar. 23, 2010

(54) EMERGENCY FLARE CASE AND STAND AND METHOD OF USE THEREOF

(76) Inventor: Andy L. Wishert, 409 Lundy, El Campo, TX (US) 77437

( * ) Notice: Subject to any disclaimer, the term of this patent is extended or adjusted under 35 U.S.C. 154(b) by 0 days.

(21) Appl. No.: 12/284,941

(22) Filed: Sep. 26, 2008

(51) Int. Cl.
*F42B 4/26* (2006.01)

(52) U.S. Cl. ..... 102/343; 102/342; 116/63 P; 248/519

(58) Field of Classification Search ..... 102/343, 102/342; 116/63 P; 248/519
See application file for complete search history.

(56) References Cited

U.S. PATENT DOCUMENTS

| | | | | |
|---|---|---|---|---|
| 2,220,407 | A | 11/1940 | Joss | |
| 2,595,939 | A * | 5/1952 | Griffith | 102/343 |
| 2,681,807 | A * | 6/1954 | Krafft | 279/29 |
| 3,224,232 | A * | 12/1965 | Dzvonik | 102/343 |
| 3,611,934 | A | 10/1971 | Schaefer | |
| 3,954,059 | A * | 5/1976 | Langseth | 102/343 |
| 4,055,840 | A * | 10/1977 | Uchytil et al. | 340/321 |
| 5,012,923 | A | 5/1991 | Hayes | |
| 5,094,422 | A | 3/1992 | Tiffany | |
| 5,149,912 | A * | 9/1992 | Waidner et al. | 102/343 |
| 6,394,522 | B1 | 5/2002 | Ingoldt | |
| 6,502,343 | B2 | 1/2003 | Cheng | |
| 6,527,245 | B2 | 3/2003 | Graves et al. | |
| 7,191,729 | B2 | 3/2007 | DeGroat, Jr. | |

* cited by examiner

*Primary Examiner*—J. Woodrow Eldred
(74) *Attorney, Agent, or Firm*—Robert C. Montgomery

(57) ABSTRACT

The invention discloses a container and support stand for conventional road flares, thereby allowing said stand to support flares during use. The device consists of multiple round flare holders or tubes, which are snapped around a central core holder. The core holder will accommodate four (4) to six (6) flares dependent upon the model. Each flare tube has a waterproof cap. To use, a person would select one or more flare tubes from the central core, remove each cap, and slide out the flare. A locking system to prevent the flare from falling all of the way back into the tube is then activated, along with a spring-levered two-foot support stand. The stand is then deployed with the flare ignited and dropped into the tube. When finished, the spent flare can be discarded, a new one placed in the holder, the cap replaced, and the holder snapped back into the central core holder, thus making the device ready for the next use.

12 Claims, 5 Drawing Sheets

EMERGENCY FLARE CASE AND STAND AND METHOD OF USE THEREOF

RELATED APPLICATIONS

The present invention was first described in an Official Record of Invention on Feb. 15, 2007 that is on file at the offices of Montgomery Patent and Design, LLC, the entire disclosures of which are incorporated herein by reference.

FIELD OF THE INVENTION

The present invention relates generally to a flare case assembly for supporting and dispensing at least one existing road flare, comprising a tubular holder, a lid removably attached to said holder, a means for supporting said holder at an erected position, and a means for raising and lowering at least one existing road flare along a linear travel path partially defined along a longitudinal length of said holder.

BACKGROUND OF THE INVENTION

Motor vehicle accidents account for more deaths than all natural disasters combined. In fact, in the United States the chances of being injured in a motor vehicle accident is better than one in a thousand (1:1000) in any year. However, not all motor vehicle accidents occur while driving.

It is all too often we hear or read about a motor vehicle striking a disabled vehicle on the side of a road or highway. Such accidents often have disastrous results for not only the passengers in the oncoming vehicle, but for those in the broken down vehicle as well. While emergency flashers help somewhat in this situation, they are often not bright enough to alert oncoming drivers to the possible dangers. Emergency response personnel often use road flares to help in this matter. While such flares are certainly bright enough, they do suffer from several disadvantages. First, their small size makes them difficult to find in a crowded trunk. Secondly, their somewhat fragile nature makes them prone to physical and/or water damage. Thirdly, when lit and deployed, they may tend to roll away, thus negating their effectiveness. Finally, should they roll to the side of the road they can catch adjacent grass areas on fire, thus greatly escalating the severity of the emergency situation. Accordingly, a need exists for a means by which road flares can be carried, stored, and deployed in a manner that eradicates the disadvantages listed above. The development of the present invention fulfills this need.

U.S. Pat. No. 7,191,729 filed by DeGroat discloses a flare carrier and support. This patent does not appear to disclose a tubular container capable of maintaining a flare nor does it appear to disclose a sliding mechanism for extending the flare out of the tubular member.

U.S. Pat. No. 6,527,245 filed by Graves and Dahlberg discloses a traffic control flare holder that is attachable to a traffic cone. This patent does not appear to disclose a flare case and stand that is freestanding nor does it disclose a tubular container capable of maintaining a flare and possessing a sliding mechanism for extending a flare out of the tubular member.

U.S. Pat. No. 6,502,343 filed by Cheng discloses an emergency rescue device that launches flares for rescue purposes. This patent does not appear to disclose a flare case and stand that will maintain and support activated roadside flares.

U.S. Pat. No. 6,394,522 filed by Ingoldt discloses a magazine for road flares. This patent does not appear to disclose a tubular container capable of maintaining a flare nor does it appear to disclose a sliding mechanism for extending the flare out of the tubular member.

U.S. Pat. No. 5,094,422 filed by Tiffany discloses a stackable flare base. This patent does not appear to disclose a This patent does not appear to disclose a flare case and stand that possesses a tubular container capable of maintaining a flare nor does it appear to disclose a sliding mechanism for extending the flare out of the tubular member.

U.S. Pat. No. 5,012,923 filed by discloses a subdivided flare-holding container. This patent does not appear to disclose a flare case and stand that is capable of maintaining and supporting an activated flare.

U.S. Pat. No. 3,611,934 filed by Schaefer discloses an apparatus for setting safety flares. This patent does not appear to disclose a flare case and stand that possesses a tubular container capable of maintaining a flare nor does it appear to disclose a sliding mechanism for extending the flare out of the tubular member.

U.S. Pat. No. 2,220,407 filed by joss discloses a container for signal flares. This patent does not appear to disclose a flare case and stand that possesses a tubular container capable of maintaining a flare nor does it appear to disclose a sliding mechanism for extending the flare out of the tubular member.

The prior art appears to disclose various apparatus that contain flares and are capable of maintaining and supporting activated flares. The prior art does not appear to disclose a flare case and stand that possesses a tubular container capable of maintaining a flare nor does the prior art appear to disclose a sliding mechanism for extending the flare out of the tubular member.

SUMMARY OF THE INVENTION

In view of the foregoing disadvantages inherent in the prior art, it has been observed that there is need for a flare case and stand and method for storing as well as providing a means to support conventional road flares in a tubular holder.

An object of the present invention provides for a flare case and stand to comprise a holder of tubular design, a lid, a support stand, a platform, a tab, and a core holder. Each tubular holder would be made of metal or other heat resistant material to accommodate the heat generated during use. Wire bending and forming would be utilized for the formation of the spring-loaded support stand. The remaining components of the flare case and stand, such as the core holder and/or the waterproof lid would be made of plastic in an injection molding process. Such a process would require the design and use of custom molds.

Another object of the present invention provides for the flare case and stand to further comprise a plurality of sizes according to the size of the flare, purpose of the flare, number of flares required, and other user preferences.

Another object of the present invention provides for the flare case and stand to further comprise a tubular holder of a general open-ended cylindrical tube shape fabricated of a fire proof material or material that resists heat up to a high temperature. The holder is envisioned to comprise an exterior surface and an interior surface defining a cavity. The holder comprises a bottom wall and a hollow cylindrical surface surrounding an open upper face, which in conjunction define the tubular holder extending from said bottom wall to the upper open face. The holder further comprises an opened upper face and a closed lower face with a platform intermediated therebetween. The flare case and stand is ergonomically designed to envelope substantially the entire area of a flare. An open upper face is formed leading towards a cavity designed to removably receive a flare.

Still another object of the present invention provides for the flare case and stand to comprise a removably attachable lid such that the inside surface of said lid abuts against the outer diametrical surface of a gasket which is integrally attached to said upper portion of the holder. Alternatively, the rubber gasket or other sealing means may be integrated around the periphery of the underside surface of the lid.

Still another object of the present invention provides for the lid to comprise an inner wall adapted to correspondingly match the outer surface of the gasket, thereby sealing the lid into place. Alternatively, the lid may comprise a means to snap onto the holder or a threaded inside wall defining a bore for correspondingly receiving the outer wall of a holder defining a threaded or grooved region positioned at the upper opening for receiving and cooperating with the inside wall of the lid for secure placement. The lid is secured therewith the tubular holder via a strapping mechanism. Connection loops allow the points of connection of the chain thereon the lid and the tubular holder.

Yet another object of the present invention provides for the tubular holder to further comprise a tab movably motioned within a track incorporated along the partial length of each tubular holder to assist in the raising of the flare whenever so desired to be ignited. The track is defined on the holder for the upward and later downward movement of the flares. The tab is interconnected therewith a platform that which the base of the flare rests upon.

Yet another object of the present invention provides for the flare case and stand to comprise self-supporting in a tripod stance upon the surface via a support stand. The support stand comprises two (2) legs with a contact member positioned at the distal end thereof to come in contact with the ground and a circular cross-section. The support stand is pivotable about the outside surface of the tubular holder, pivotally affixed thereto the proximal end of said holder.

Yet another object of the present invention provides for the flare case and stand to be tilted backward such that the contact members of the support stand remains in engagement with the ground in a readily stable stance capable of resisting overturning forces. When deployed in this fashion, the flare case and stand may stand on almost any grade of ground.

Still yet another object of the present invention provides for the flare case and stand is envisioned to comprise a core holder designed to removably receive one (1) or more holders. The apertures are comparably equal in size, equidistantly-spaced apart, frictionally fits against the outer surface periphery of the tubular holder to be effectively locked in place, securely and removably held in a stored position, and envisioned to be shaped in a semicircular or arch-like formation sized slightly larger than that than the outer diameter of the tubular holder to stably and frictionally secure placement of said holders.

Still yet another object of the present invention provides for the core holder with a plurality of apertures to releasably secure multiple flares at equal intervals. The core holder may be loaded with tubular holders with the option of containing flares and stored in the trunk or other storage area in a vehicle.

Still yet another object of the present invention provides for the flare case and stand to comprise a sturdy and resilient construction enabling it to avoid overturning forces and frequent and repetitive utilization.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

Figure 1:
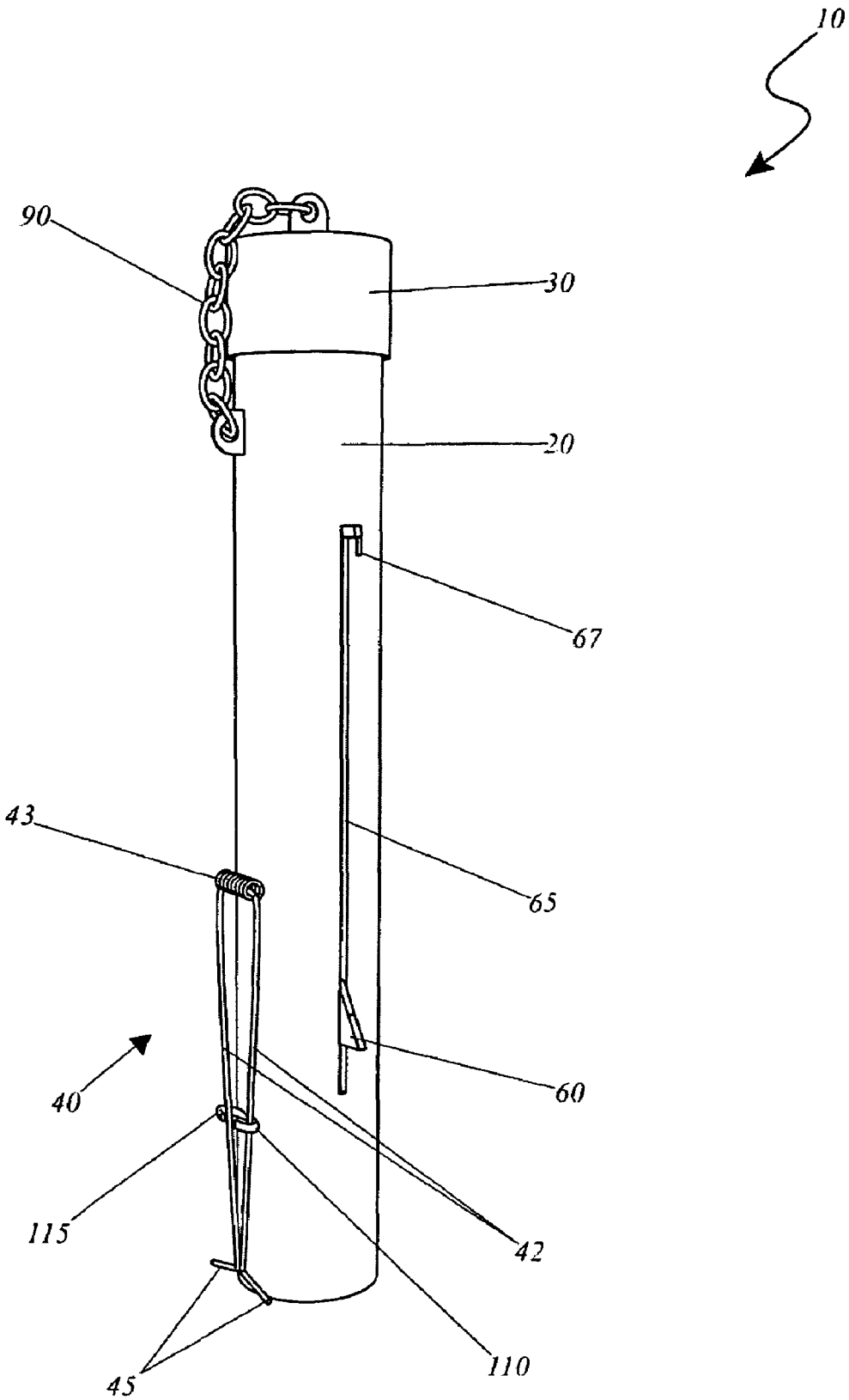
FIG. 1 is a perspective view of a tubular holder 20 with a lid 30 removably attached thereon, according to the preferred embodiment of the present invention.

| | |
|---|---|
| 10 | emergency flare case and stand |
| 20 | tubular holder |
| 22 | bottom wall |
| 25 | cavity |
| 27 | upper open face |
| 28 | gasket |
| 30 | lid |
| 40 | support stand |
| 42 | leg |
| 43 | coiled spring |
| 45 | contact member |
| 50 | platform |
| 60 | tab |
| 65 | track |
| 67 | notch |
| 70 | core holder |
| 75 | aperture |
| 80 | flare |
| 90 | chain |
| 100 | upward movement |
| 105 | downward movement |
| 110 | clip |
| 115 | prong |
| 120 | inward movement |
| 125 | outward movement |

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an apparatus and method for storing as well as providing a means to support conventional road flares 80 in a tubular holder 20. The flare case and stand (herein described as the "apparatus") 10 comprises a holder 20 of tubular design, a lid 30, a support stand 40, a platform 50, a tab 60, and a core holder 70. Each tubular holder 20 would be made of metal or other heat resistant material to accommodate the heat that it may be exposed to during use. Wire bending and forming would be utilized for the formation of the spring-loaded support stand 40. The remaining components of the apparatus 10, such as the core holder 70 and/or the waterproof lid 30 would be made of plastic in an injection molding process. Such a process would require the design and use of custom molds. The apparatus 10 is envisioned to be introduced in a plurality of sizes according to the size of the flare 80, purpose of said flare 80, number of flares 80 needed, and other user preferences.

Referring now to FIG. 1, a perspective view of a tubular holder 20 with a lid 30 releasably attached thereon, is disclosed according to the preferred embodiment of the present invention. The apparatus 10 is envisioned to comprise a tubular holder 20 of a general open-ended cylindrical tube shape fabricated of a fire proof material or material that resists heat up to a high temperature. The holder 20 is envisioned to comprise an exterior surface and an interior surface defining a cavity 25. The holder 20 is envisioned to comprise a bottom wall 22 and a hollow cylindrical surface surrounding an open upper face 27, which in conjunction, define the tubular holder 20 extending from said bottom wall 22 to the upper open face 27. The holder 20 comprises an opened upper face 27 and a closed lower face 22 with a platform 50 intermediated therebetween. The apparatus 10 is ergonomically designed to envelope substantially the entire area of a flare 80. An open upper face 27 is formed leading towards a cavity 25 designed to removably receive a flare 80. The length and circumference of the holder 20 may be altered such to allow flares 80 of a plurality of sizes and functions to be inserted therein.

Figure 2:
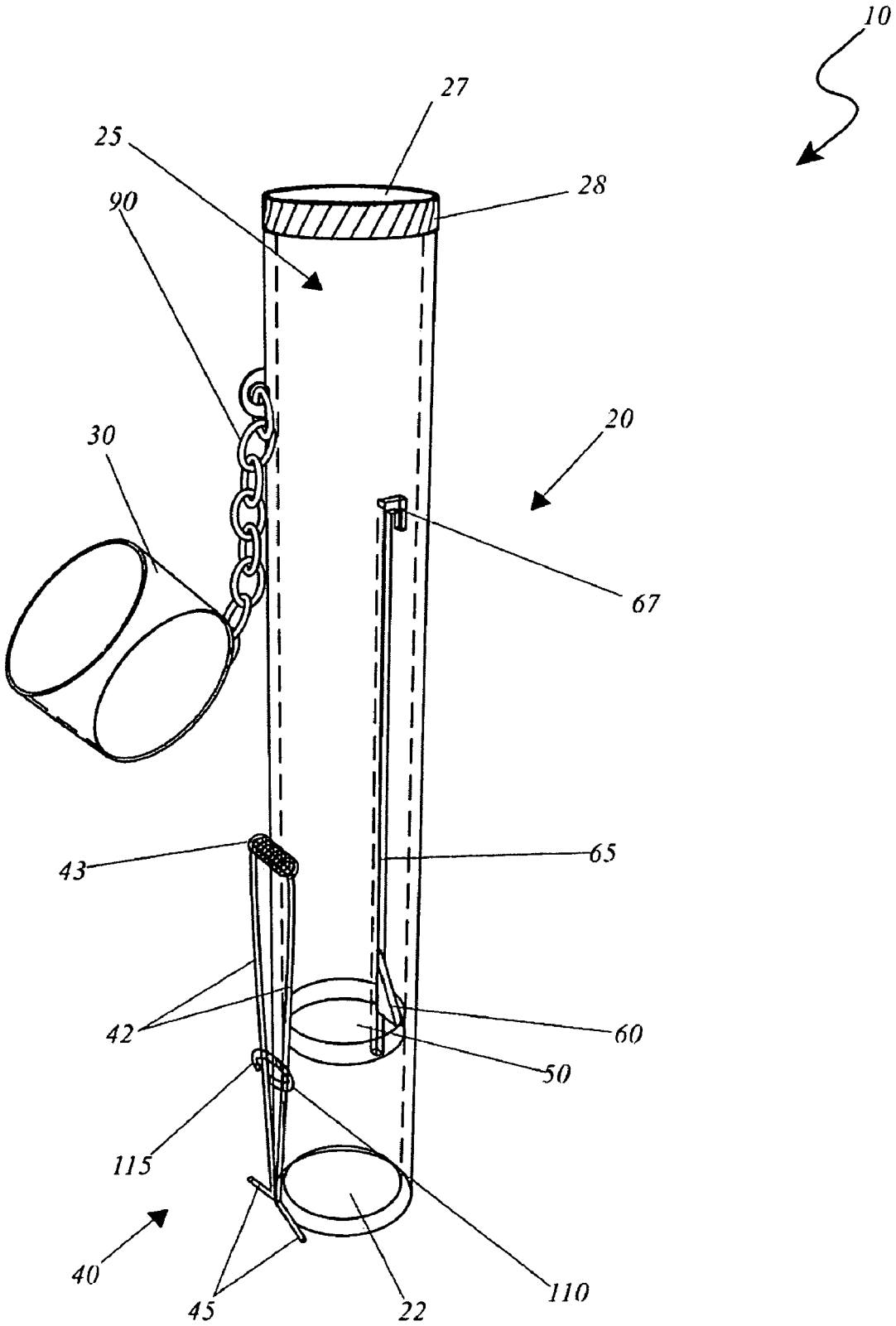
FIG. 2 is an inside perspective view of the tubular holder 20 with the lid 30 attachably removed therefrom, according to the preferred embodiment of the present invention.

Referring now to FIG. 2, a perspective inside view of the tubular holder 20 with the lid 30 attachably removed therefrom, is disclosed according to the preferred embodiment of the present invention. The apparatus 10 is comprised of a removably attachable lid 30 slightly larger than that of the exterior surface of the upper portion of the holder 20 such that the inside surface of said lid 30 abuts thereagainst the outer diametrical surface of a gasket 28, which is integrally attached thereto said upper portion of the holder 20. To provide a good seal against the entry of water there is a rubber gasket 28 or other sealing means around the periphery of the upper surface of the holder 20. Alternatively, the rubber gasket 28 or other sealing means may be integrated around the periphery of the underside surface of the lid 30. The lid 30 is envisioned to comprise an inner wall adapted to correspondingly match the outer surface of the gasket 28, thereby sealing the lid 30 into place. Alternatively, the lid 30 may comprise a means to snap onto the holder 20 or a threaded inside wall defining a bore for correspondingly receiving the outer wall of a holder defining a threaded or grooved region positioned at the upper opening 27 for receiving and cooperating with the inside wall of the lid 30 for secure placement. The lid 30 engages the rubber gasket 28 thereby disposing the upper opening 27 of the holder 20 in the bore. However, other fastening means may be utilized as adequate securement of the lid 30 thereon the holder 20. The lid 30 is secured therewith the tubular holder 20 via a strapping mechanism, preferably a chain 90 having links, as depicted in the figures. The strapping mechanism may be of any other device suitable to secure the lid 30 therewith the holder 20 and capable of withstanding the heat expelled therefrom a lit flare 80. Connection loops allow the points of connection of the chain 90 thereon the lid 30 and the tubular holder 20.

Figure 3:
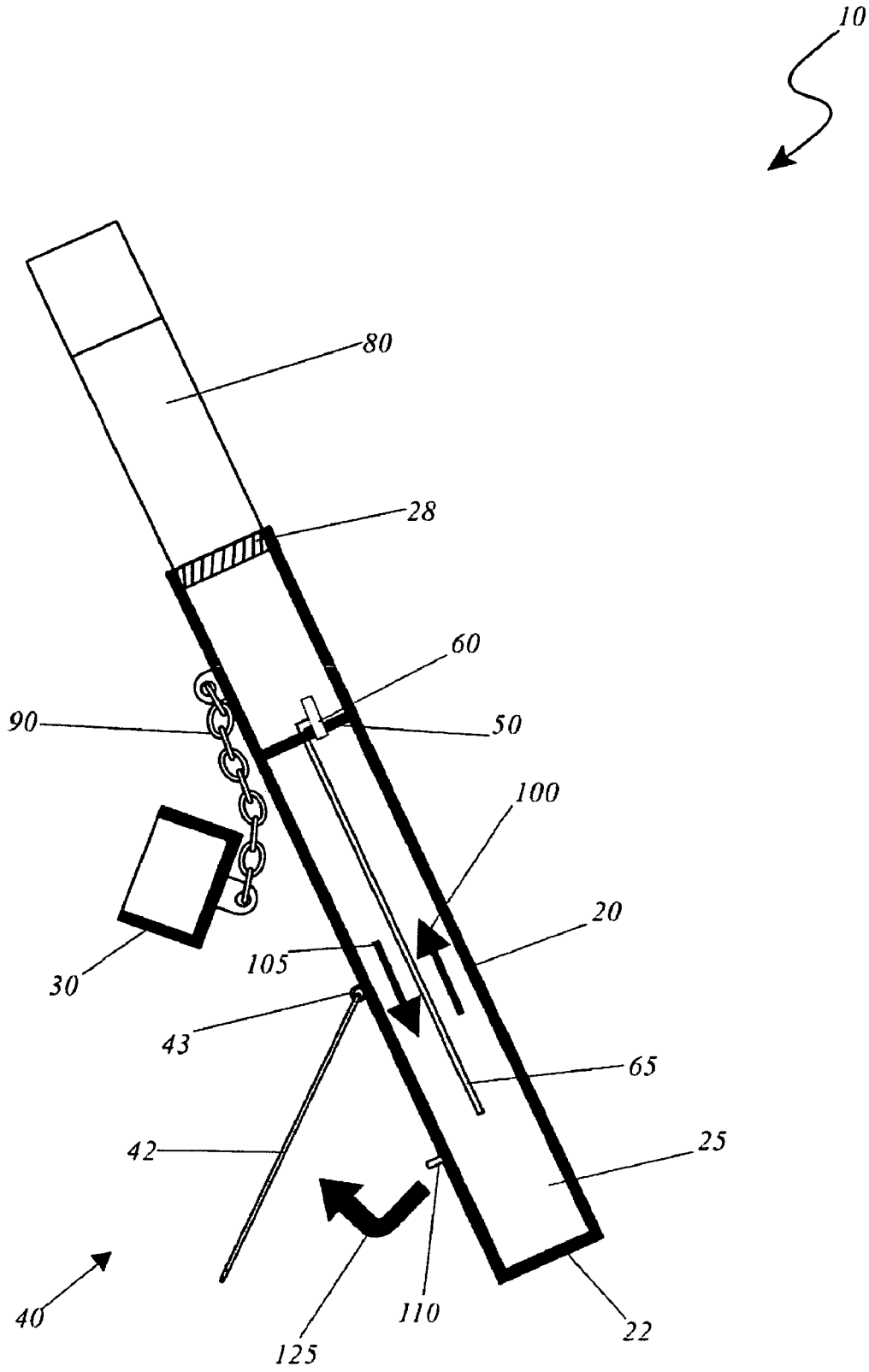
FIG. 3 is an inside side view of the tubular holder 20 with the lid 30 attachably removed therefrom and a flare 80 protruding therefrom open upper face 27, according to the preferred embodiment of the present invention.

Referring now to FIG. 3, an inside side view of the tubular holder 20 tilted, is disclosed according to the preferred embodiment of the present invention. A tab 60 or the like is envisioned to be movably motioned within a track 65 incorporated along the partial length of each tubular holder 20. The track 65 is defined thereon the holder 20 for the upward 100 and later downward 105 movement of the flares 80. The tab 60 is interconnected therewith a platform 50 that which the base of the flare 80 rests thereupon. The tab 60, integrally attached thereto a platform 50 residing therein the cavity 25 of the tubular holder 20, projects tangentially outward therefrom the tubular holder 20 for operative movements given by a user. The tab 60 is utilized to assist in the raising of the flare 80 whenever so desired to be ignited. Said tab 60 may be manipulated or moved upwardly 100, thus raising the platform 50 for which the bottom surface of the flare 80 rests upon, to lift the desired flare 80 thereout of the tubular holder 20. The flare 80 thus can then be moved up 100 (raised) so that the upper portion of the flare 80 is exposed therefrom the tubular holder 20. For insertion of the desired flare 80, the tab 60 would be lowered 105, thus lowering 105 the platform 50 for which the bottom surface of the flare 80 rests upon, and the flare 80 may then be inserted therein the cavity 25 of the tubular holder 20. The platform 50 is integrated therein for the raising of the flare 80 upwardly 100 therefrom the cavity 25.

The tab 60 integrated therewith said platform 50 to be motioned upward 100 to impulse said platform 50 and thereby impelling the flare 80 upwardly 100 therethrough the cavity 25 until said flare 80 is partially exposed. The tab 60 slides along a vertical track 65 or slotted opening with a notch 67 integrated thereon the uppermost portion of said track 65. Whenever it is so desired to move the flare upwardly 100, the tab 60 may be slid along the vertical track 65 and positioned in the notch 67 where it will rest at the uppermost portion of said slot 65 such that said flare 80 is in the exposed position protruding therefrom the upper open face 27. Alternatively, the tab 60 may be motioned upwardly 100 in intervals separated by "clicks" to allow the flare 80 to adjustably protrude outwardly therefrom the open upper face 27 of the tubular holder 20. It will be appreciated to those skilled in the art that other tab 60 and track 65 designs or other means to permit raising, locking into place, and subsequent lowering 105 of the platform 50 may also be used in accordance with the invention 10 without intervening with the scope of the invention 10.

Figure 4:
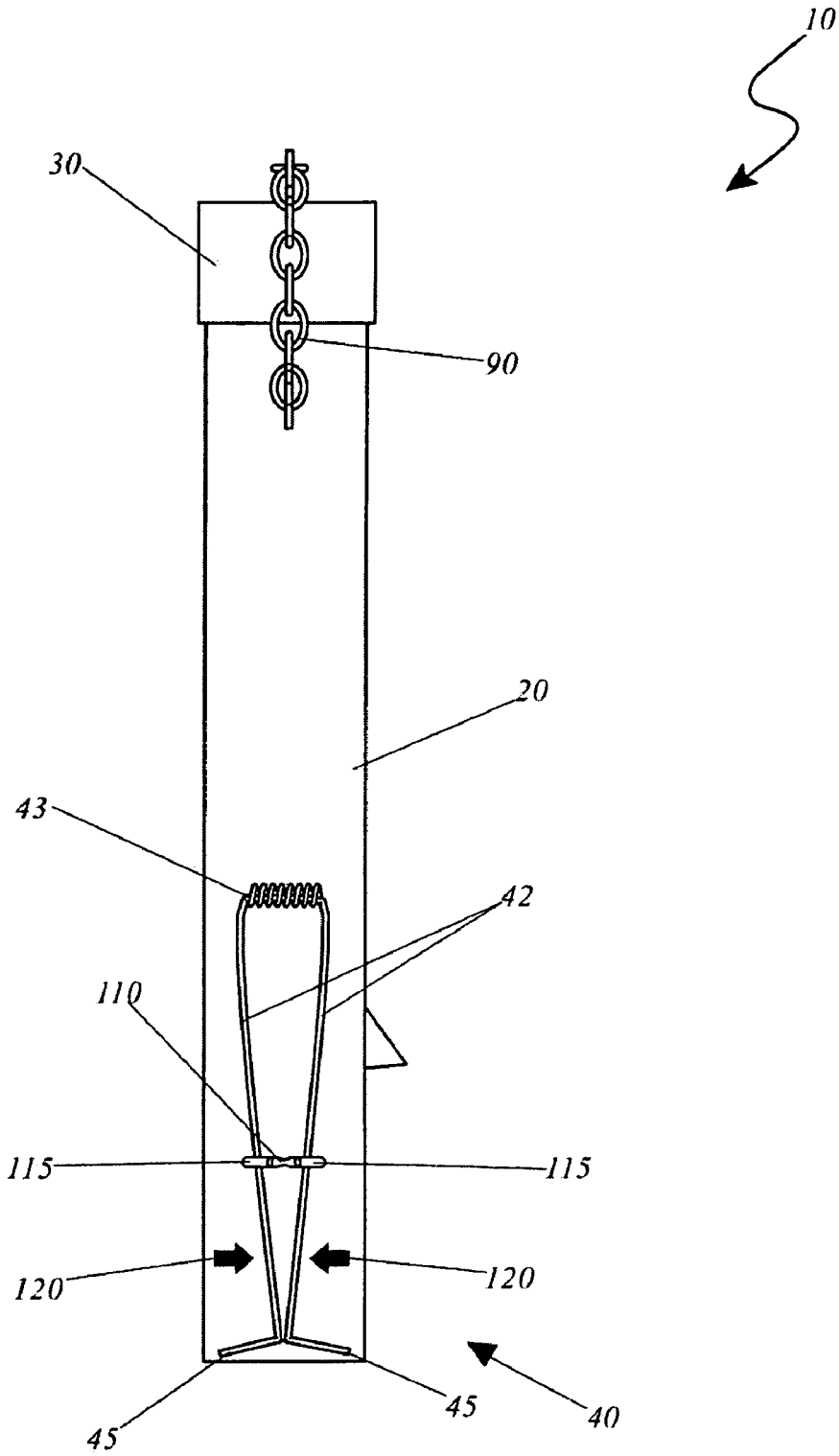
FIG. 4 is a side view of the tubular holder 20 with the lid 30 removably attached thereon, according to the preferred embodiment of the present invention; and, FIG. 5 is a perspective view of a plurality of tubular holders 20 releasably secured thereto a core holder 70, according to the preferred embodiment of the present invention.

Referring now to FIG. 4, a side view of the tubular holder 20 is disclosed according to the preferred embodiment of the present invention. The apparatus 10 is envisioned to be self-supporting in a tripod stance upon the surface via a support stand 40. The support stand 40 comprises two (2) legs 42 each shaped much like an "L" with a contact member 45 positioned at the distal end thereof to come in contact with the ground. The support stand 40 is envisioned to comprise a circular cross-section with two (2) legs 42 extending from the coiled spring 43 angularly thereto leading towards a contact member 45 in which contacts the ground. Whenever so desired, support stand 40 may be removed therefrom a retaining clip 110 by squeezing the two (2) legs 42 inwardly 120 towards each other and then pulling outwardly 125 therefrom the tubular holder 20. The support stand 40 is pivotable about the outside surface of the tubular holder 20, pivotally affixed thereto the proximal end of said holder 20. The two (2) legs 42 are pivotally secured to the outside surface of the tubular holder 20 via a coiled spring 43. Said two (2) legs 42 are interconnected therewith each other via the spring 43, in which is envisioned to be utilized to provide the momentum force about a pivoting axis transverse thereto the length of the tubular holder 20 as well as parallel thereto the upper side surface of the tubular holder 20 and the base 22 of said holder 20. The coiled spring 43 provides the means to bias the two (2)

legs 42 outward from each other as well as pivot outwardly 125 therefrom the tubular holder 20 to an extended orientation. The legs 42 are biased outwardly therefrom each other as well as the support stand 40 is biased rotatably outwardly 125 from a stored orientation, as depicted in FIGS. 1 and 2, to an extended orientation, as depicted in FIG. 3, via the coiled spring 43 but may later have the legs 42 pushed together and inward 120 therewithin the clip 110 whereas the apparatus 10 is then in the stored orientation. The clip 110 engages both legs 42 via prongs 115 thereby providing a means to transform the stored energy of the coiled spring 43, when in the stored orientation, to kinetic energy whenever so released. The kinetic energy provides the momentum force thereby rotating 125 the support stand 40 about the axis of the coiled spring 43 as well as biasing the two (2) legs 42 outwardly. When in the stored orientation, the legs 42 instigate tension along the axis of the spring 43. The retention of the support stand 40 charges the coiled spring 43 such to provide a stored energy awaiting to be released into kinetic energy such to provide a rotational motion 125 to bring out the support stand 40 and the legs 42 outward 125.

Whenever extended, the apparatus 10 may then be tilted backward such that the contact members 45 of the support stand 40 remains in engagement with the ground in a readily stable stance capable of resisting overturning forces. In this configuration, the apparatus 10 may stand on almost any grade of ground. Whenever not needed, the support stand 40 may fully retract inward towards the tubular body 20. The legs 42 may be squeezed together 120 and inserted therebetween the two (2) prongs 115 of the clip 110 and released thereby locking the support stand 40.

Figure 5:
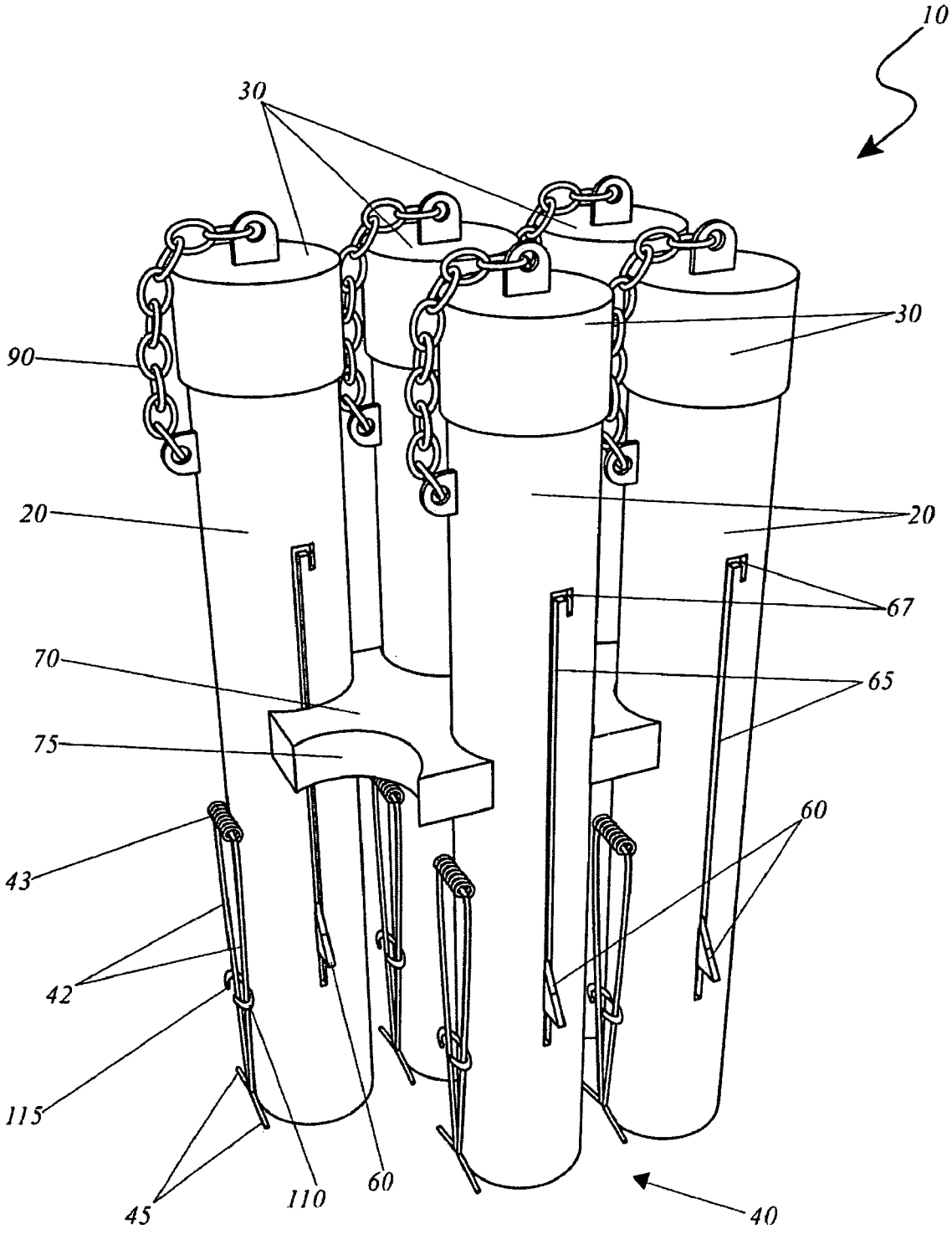

Referring now to FIG. 5, a perspective view of a plurality of tubular holders 20 releasably secured thereto a core holder 70. The apparatus 10 is envisioned to comprise a core holder 70 designed specifically to removably receive one (1) or more holders 20. The core holder 70 is envisioned to comprise at least four (4) semicircular apertures 75 for operably receiving the holders 20. The apertures 75 are comparably equal in size comprising a periphery wall being curvilinear separated by a sold surface. Each aperture 75 is equidistantly spaced apart with a periphery that is designed to align with the periphery of the outer surface of the tubular holder 20. Each aperture 75 frictionally fits thereagainst the outer surface periphery of the tubular holder 20 to be effectively locked in place, securely and removably held in a stored position. The apertures 75 are envisioned to be shaped in a semicircular or arch-like formation sized slightly larger than that than the outer diameter of the tubular holder 20 to stably and frictionally secure placement of said holders 20 therein. The apertures 75 are envisioned to be shaped in an arch-like formation thus to stably hold the tubular holders 20 that may vary in size and/or shape in an arrangement where said holders 20 may be easily removed. The apertures 75 are envisioned to be equidistantly positioned in at least two (2) columns and two (2) rows or in other selected positions depending on the size of the tubular holders 20, number of tubular holders 20, and/or other personal preferences of a user. The apertures 75 are substantially identical in size shaped to correspond with the outer surface of the tubular holder 20, although it will be understood that the apertures 75 could be formed of sizes and/or shapes that are substantially different than one (1) another.

The preferred embodiment of the present invention can be utilized by the common user in a simple and effortless manner with little or no training. After initial purchase or acquisition of the apparatus 10, it would be configured as indicated in FIGS. 1 through 5.

The method of utilizing the device 10 may be achieved by performing the following steps: removing the apparatus 10 from the storage location; grasping the tubular holder 20 releasably secured therein the core holder 70; removing said tubular holder 20 therefrom the designated aperture 75 of said core holder 70; removing the lid 30 therefrom the upper portion of the tubular holder 20 thereby exposing the upper open face 27; motioning the tab 60 upwardly 100 therealong the vertical track 65 and locking into place by placing said tab 60 within the notch 67 thereby exposing the flare 80; squeezing the legs 42 inwardly 120 towards one (1) another; while still squeezing, pull said legs 42 outwardly 125 therefrom the clip 110; releasing the legs 42 thereby motioning the legs 42 outward from one (1) another; placing the apparatus 10 and flare 80 protruding outwardly therefrom on the desired surface; igniting said flare 80; replacing flare 80 after usage into the tubular holder 20; releasing the tab 60 therefrom the notch 67; motioning the tab 60, and consequently the replaced flare 80, downwardly 105; replacing the lid 30 thereon the uppermost portion of the tubular holder 20 thereby closing the upper open end 27; squeezing the two (2) legs 42 inwardly 120 towards one (1) another; motioning the legs 42 towards the tubular holder 20 until placed therebetween the prongs 115 of the clip 110; releasing the legs 42 thereby allowing the legs 42 to spring outwardly 125 and rest within said prongs 115; and, releasably securing the tubular holder 20 within an aperture 75 of the core holder 70.

The apparatus 10 comprises a core holder 70 with a plurality of apertures 75 capable of releasably securing multiple flares 80 at equal intervals. The core holder 70 is envisioned to comprise a plurality of tubular holders 20 for transport and storage. The core holder 70 may be loaded with tubular holders 20 with the option of containing flares 80 and stored in the trunk or other storage area in a vehicle. Lids 30 are frictionally placed thereon the uppermost portion of the tubular holder 20 utilizing a rubber gasket 28 to protect the flares 80 residing therein the tubular holder 20 from inclement weather. The flare 80 is placed within the cavity 25 such that the bottom surface of said flare 80 rests thereupon the platform 50. The platform 50 serves as a support as well as means to lift 100 the flare 80 whenever so desired. The tab 60 is integrally attached thereto the platform 50 which slides therealong a vertical track 65. At the uppermost portion of said track 65 is a notch 67 to serve as a stop in which the tab 60, and consequently the platform 50 may be stopped. At this position, the flare 80 is protruding partially out of the upper open face 27 of the tubular holder 20. Thus the flares 80 are elevated so as to provide a better visibility of the burning flare 80 from a distance and/or around obstacles.

The two (2) legs 42 form a substantially single unit interconnected via a coiled spring 43 which provides the momentum force outward 125. When the support stand 40 is extended outwardly 125, the tubular holder 20 can then be placed on the ground tilted in a self-supporting tripod stance. The support stand 40 extends outwardly 125 to serve as a means to support the flare 80 at an upward extending angle with respect to the ground. The contact members 45 extend outwardly therefrom the two (2) legs 42 such to provide stabilization. The weight and sturdy construction of the apparatus 10 insures stability and resists overturning forces. The flare 80 then can be ignited to be set up along a highway, for example, to signal oncoming traffic of a breakdown, accident, and/or other highway problems. When the flares 80 are spent, said flares 80 may be replaced within the tubular holder 20 for next-time utilization. After utilization of the apparatus 10, the support stand 40 may be retracted against the tubular holder 20 and held in place via a clip 110. The tubular holder 20 can then be reinstalled therein the core holder 70. Therefore, the apparatus 10 is designed to be sturdy to avoid overturning forces and designed for frequent and repetitive utilization.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A flare case assembly for supporting and dispensing at least one existing road flare, said flare case assembly comprising:

a tubular holder;

a lid removably attached to said holder;

means for supporting said holder at an erected position, further comprising a spring-loaded support stand attached to said holder, said spring-loaded support stand comprising:

a plurality of substantially L-shaped legs positioned at a distal end of said holder and engaged with a ground surface;

a coiled spring attached to said holder and said legs respectively; and, a retaining clip removably positioned about said legs;

wherein said support stand is pivotal about an axis registered orthogonal to a longitudinal length of said holder; and, means for raising and lowering said at least one existing road flare along a linear travel path partially defined along a longitudinal length of said holder, further comprising:

a platform dynamically seated within said holder;

a track formed along partial length of said holder; and, a tab coupled to said platform and being movably motioned within said track for biasing said tab upward and downward within said holder, said tab being seated exterior of said holder and tangentially oriented therewith;

wherein said track has a notch integrated at an uppermost portion thereof, said tab being slidably displaced along said track and removably positioned in said notch, said tab being maintained at an uppermost portion of said track such that said at least one existing road flare is a partially exposed exterior of said holder.

2. The flare case assembly of claim 1, wherein said coiled spring is directly attached to said holder and said legs respectively.

3. The flare case assembly of claim 1, wherein said retaining clip comprises: a pair of prong ends releasably engaged to said legs;

wherein said retaining clip biases said legs inwardly at a tensed position from a spaced equilibrium position; and, wherein said coiled spring raises said legs upwardly from a lowered tensed position.

4. The flare case assembly of claim 1, wherein said supporting means further comprises:

a core holder releasably secured to said holder, said core holder including a plurality of arcuate depressions formed along a periphery thereof, each of said depressions having an inner circumference approximately equal to an outer circumference of said holder such that said holder frictionally fits within a corresponding one of said depression inner circumferences.

5. The flare case assembly of claim 1, wherein said lid comprises: a chain tethered thereto as well as said holder respectively.

6. A flare case assembly for supporting and dispensing at least one existing road flare, said flare case assembly comprising:

a tubular holder having a closed bottom end and an open top end;

a lid removably attached to said holder;

means for supporting said holder at an erected position, further comprising a spring-loaded support stand attached to said holder, said spring-loaded support stand comprising:

a plurality of substantially "L"-shaped legs positioned at a distal end of said holder and engaged with a ground surface;

a coiled spring attached to said holder and said legs respectively; and, a retaining clip removably positioned about said legs;

wherein said support stand is pivotal about an axis registered orthogonal to a longitudinal length of said holder; and, means for raising and lowering said at least one existing road flare along a linear travel path partially defined along a longitudinal length of said holder, further comprising:

a platform dynamically seated within said holder;

a track formed along partial length of said holder; and, a tab coupled to said platform and being movably motioned within said track for biasing said tab upward and downward within said holder, said tab being seated exterior of said holder and tangentially oriented therewith;

wherein said track has a notch integrated at an uppermost portion thereof, said tab being slidably displaced along said track and removably positioned in said notch, said tab being maintained at an uppermost portion of said track such that said at least one existing road flare is a partially exposed exterior of said holder.

7. The flare case assembly of claim 6, wherein said coiled spring is directly attached to said holder and said legs respectively.

8. The flare case assembly of claim 6, wherein said retaining clip comprises: a pair of prong ends releasably engaged to said legs;

wherein said retaining clip biases said legs inwardly at a tensed position from a spaced equilibrium position; and, wherein said coiled spring raises said legs upwardly from a lowered tensed position.

9. The flare case assembly of claim 6, wherein said supporting means further comprises:

a core holder releasably secured to said holder, said core holder including a plurality of arcuate depressions formed along a periphery thereof, each of said depressions having an inner circumference approximately equal to an outer circumference of said holder such that said holder frictionally fits within a corresponding one of said depression inner circumferences.

10. The flare case assembly of claim 6, wherein said lid comprises: a chain tethered thereto as well as said holder respectively.

11. A method for supporting and dispensing an existing road flare, said method comprising the steps of:

providing a core holder and a holder removably attached thereto, said holder having a lid, a tab, a track and a support stand respectively attached thereto, said support stand having a plurality of legs, a coil spring and a retaining clip respectively;

removably grasping said holder from said core holder;

removing said lid from said holder;

motioning said tab upwardly along said track;

locking said tab into place by placing said tab within a notch formed within said track exposing a top end of said existing road flare;

squeezing said legs inwardly towards each other;

while squeezing said legs, pulling said legs outwardly from said retaining clip;

releasing said legs and thereby motioning said legs outward from each other;

placing holder on a desired surface; and, igniting said existing road flare.

12. The method of claim 11, further comprising the steps of:

placing a new one of said existing road flare into said holder;

releasing said tab from said notch;

motioning said tab and said new road flare downwardly along said holder;

replacing said lid on said holder;

squeezing said legs inwardly towards each other;

motioning said legs towards said holder until positioned between said retaining clip;

releasing said legs and thereby allowing said legs to spring outwardly and rest within said retaining clip; and, releasably securing said holder to said core holder.

* * * * *